United States Patent [19]

Grimaud

[11] Patent Number: 4,841,703

[45] Date of Patent: Jun. 27, 1989

[54] FLOOR WITH CO-OPERATION BETWEEN WOOD AND CONCRETE

[75] Inventor: Alain Grimaud, Saint Bonnet, France

[73] Assignee: Enterprise Paris Quest, Paris, France

[21] Appl. No.: 159,986

[22] Filed: Feb. 24, 1988

[30] Foreign Application Priority Data

Feb. 26, 1987 [FR] France ..... 87 02559

[51] Int. Cl.[4] ..... F04B 1/16

[52] U.S. Cl. ..... 52/334; 52/378

[58] Field of Search ..... 52/334, 733, 414, 410, 52/408, 602, 378, 379

[56] References Cited

U.S. PATENT DOCUMENTS

| | | | |
|---|---|---|---|
| 1,596,706 | 8/1926 | Bartels | 403/297 |
| 2,987,855 | 6/1961 | Singleton et al. | 52/334 |
| 3,066,448 | 12/1962 | Pinter | 52/733 |
| 3,210,900 | 10/1965 | Sattler | 52/334 |
| 3,363,379 | 1/1968 | Curran | 52/334 |
| 3,401,497 | 9/1968 | Gregory, Jr. et al. | 52/733 |
| 3,720,029 | 3/1973 | Curran | 52/334 |
| 3,757,482 | 9/1973 | Haeussler | 52/410 |
| 4,651,487 | 3/1987 | Nishikawa | 52/334 |

FOREIGN PATENT DOCUMENTS

| | | |
|---|---|---|
| 673556 | 3/1939 | Fed. Rep. of Germany . |
| 2008402 | 11/1971 | Fed. Rep. of Germany . |
| 2306313 | 10/1976 | France . |
| 2510163 | 1/1983 | France . |
| 223498 | 12/1942 | Switzerland . |

*Primary Examiner*—Michael Safavi

*Attorney, Agent, or Firm*—Sughrue, Mion, Zinn, Macpeak & Seas

[57] ABSTRACT

A concrete slab (8) is cast over wooden beams (2) and is connected to the beams by metal connector tubes (14) of circular section, each of which is embedded at one end by being forced into a circular groove provided for the purpose in a beam and at its other end in the slab by virtue of the concrete being cast thereover. The invention is applicable to building or converting buildings and also to works such as gangways and bridges.

10 Claims, 1 Drawing Sheet

FLOOR WITH CO-OPERATION BETWEEN WOOD AND CONCRETE

The present invention relates to making or reinforcing floors formed on beams of wood. It applies, in particular, when such beams may be taken to a site of an existing structure for the purpose of renovating, transforming, or consolidating the structure, where such structures may be dwellings, gangways, or bridges.

BACKGROUND OF THE INVENTION

The principle of a floor with co-operation between wood and concrete is known. Its strong profile is a T-shaped profile whose bottom portion is a beam of wood and whose top portion is a slab of concrete which is, generally in compression. Such a slab is cast onto shuttering which may optionally be retained or removed, and which is disposed on the beams or between the beams.

Co-operation between the wood and the concrete is provided by metal connectors whose stiffness and retention both in the wood and in the concrete prevent any relative displacement between the component parts in the span direction, i.e. in the longitudinal direction of the beams. The distribution of the connectors is similar to the distribution of stirrup-shaped binding wires in a reinforced concrete beam.

A distribution trellis made of steel is embedded in the concrete and provides the slab with strength against transverse bending and against puncture.

For strength of materials purposes, composite beams constituted by this T-shaped profile are generally simply supported at their ends. This is the simplest case and is considered below by way of example, but it should be understood that if the beams are locally encastré or bear on intermediate supports, then forces will be locally inverted. In the present simple case, composite beams operate in simple bending. Their neutral fiber is preferably situated in the vicinity of nonremovable shuttering and the dimensions of the wood and the concrete are chosen accordingly. The concrete works in compression and the wood works in traction along the longitudinal direction, and the connectors are subjected to internal shear forces which are exerted between the wood and the concrete in the same longitudinal direction.

In a first prior floor of this type, the connectors are constituted by vertical nails which are partially engaged in the top faces of the joists through the shuttering before the slab is cast. The head and the top portion of each nail is embedded in the concrete during casting. Such a floor is described in an article by Godycki et al entitled "Verbunddecke aus Holzrippen unde Betonplatte" (Bauingenieur 59 (1984) 477–483, Springer-Verlag, West Germany). Such connectors suffer from the drawback of their middle and bottom lengths bending easily under the effects of the above-mentioned internal longitudinal forces. They then bend in the wood. This connector bending gives rise to deformation of the floor and to a reduction in its strength.

In a second prior floor, the connectors are likewise made of metal, and they are rigid. They are constituted by connection plates made of metal sheet and extending vertically and longitudinally in contact with the two sides of each beam. Pointed transverse horizontal nailing teeth may be formed by cutting and horizontally folding various zones of each such plate. These teeth penetrate into the side of the adjacent beam in order to fix the plate during an operation which may be referred to as 'nailing'. However, this operation may also be performed by means of ordinary nails extending horizontally and passing through the plates. The top portion of each plate projects above the beam and is cut to form a series of vertical pointed connection teeth which pass through the shuttering when the shuttering is put into place on the beams and which are subsequently embedded in the concrete of the slab.

One such second floor is mentioned without being described in detail in European patent document EP-Al-0104629 (Poutanen, Tuomo Tapani).

This second prior floor has the particular advantage that the shape of each connector ensures that the assembly is very rigid against bending forces constituted by the above-mentioned internal longitudinal forces. However, it suffers from various drawbacks including those mentioned below.

(1) If the above-mentioned nailing operation is performed using nailing teeth prior formed by cutting and folding various zones of the plate, then the nailing operation requires a press to be used which is capable of exerting a considerable force.

If the structure is a new building then the force is relatively easily applied by means of a large press permanently disposed in a workshop. However storing and handling beams becomes difficult after this operation has been performed because of the poor stiffness of the connection teeth and the plates in a transverse direction. However, if beams that are already in place are being used, it is generally difficult to bring such a large press into contact with the beams. Finally, if the nailing operation is performed with ordinary nails, these nails may bend in the wood.

(2) The connection teeth constitute groups within which the teeth follow one another longitudinally at small intervals. When the slab is being cast, the concrete aggregate has difficulty in inserting itself between pairs of successive teeth, thereby weakening the concrete in a zone where it is highly stressed by the connector.

(3) The connection between the plate and the beam cannot be completely rigid. If the nailing teeth are so formed when the connector is made as to occupy transverse vertical planes by folding the metal sheet about vertical fold lines, then longitudinal forces in operation can easily fold them about such vertical lines. If the teeth are formed in horizontal planes by folding about horizontal longitudinal lines, then the teeth present only a very small thrust area for longitudinal thrust inside the wood, i.e. they present an area corresponding to the thickness of the sheet, and as a result longitudinal forces applied in service can easily thrust the teeth through the wood.

(4) If it is unacceptable for the slab shuttering to be pierced by the connection teeth when the shuttering is put into place, and if it is preferred for the shuttering to be constituted by sheets of shuttering each placed on the edges of two adjacent beams, then connection plates which are nailed to the sides of the beams and which project locally above the beams get in the way when placing the shuttering plates on the beams.

(5) The bottom portions of the plates remain visible and spoil the uniform appearance of the wood.

(6) Since the plates are apparent and penetrate into the sides of the beams, the connections provided thereby are exposed to the high temperatures which can occur during a fire. They are thus unsatisfactory from the safety point of view.

The present invention seeks to provide, cheaply, a floor having co-operation between wood and concrete and which is of increased strength. More particularly, the invention seeks to provide connectors and to put them into operation in such a floor in a manner which is simple and effective and which avoids the above-mentioned drawbacks.

SUMMARY OF THE INVENTION

A floor in accordance with the invention includes some elements which are analogous to elements of the prior floor having rigid metal connectors as described above. These elements comprise:

beams of wood extending along a longitudinal direction and following one another in a transverse direction in a substantially horizontal beam plane, said beams resting on supports for supporting the floor, each beam having a top face, a bottom face, and two side faces;

a slab of concrete formed on said beams in order to constitute the floor surface and to contribute to the strength of the floor; and connectors each having a bottom length received in one of the beams and a top length received in said slab, said connectors being sufficiently stiff to transmit the internal longitudinal forces which result from bending loads applied to the floor between the concrete of said slab and the wood of said beams without said connectors suffering significant deformation.

In comparison with this prior floor, a floor according to the invention includes the improvements whereby each of said connectors is in the form of a tube, with the bottom length of said tube occupying a housing hollowed out in the wood from the top face of one of said beams such that said length constitutes an extended bearing surface for said tube to bear against the wall of said housing in response to said internal longitudinal forces, and that the stiffness of said tube spreads said forces over all of said bearing surface. Said tube being called hereafter a "connector" tube.

In accordance with the invention, it is possible, in some cases, to adopt one or more of the following preferred dispositions:

said housing and said bottom length of said connector tube are made in such a manner that the outer wall of said length is permanently pressed around substantially all of its surface against the wall of said housing;

said housing is made in the form of a groove leaving a core of wood of said beam in place;

the diameter of said connector tube is sufficient to enable the concrete to penetrate without significant segregation into inside space of the top length of said tube while said concrete slab is being cast, thereby reinforcing the embedding of said length in said slab after the concrete has set;

said connector tube is made of a material having mechanical strength which is greater than and/or more uniform than the mechanical strength of the wood from which said beams are made and the concrete from which said slab is made;

said connector tube has vertical generator lines and is circular in section so as to make manufacturing easy and so as to make it easy to provide a housing therefor in said wooden beam;

its diameter lies between 30 mm and 130 mm and preferably between about 40 mm and 100 mm;

its height lies between 6 cm and 15 cm and preferably between about 8 cm and 12 cm;

said bottom length of the connector tube penetrates into the top face of said wooden beam over a fraction which is less than one half of the height of said beam; and it has a diameter which is less than the width of said wood beam in said transverse direction, and its said bottom length remains at a distance from the sides of said beam so as to be protected against heat and/or corrosion by a thickness of wood extending up to said sides. This last disposition also makes it possible to place rectangular shuttering plates between the beams with the plates resting on the edges of the beams.

When making such a floor, the said beams are put into place along said longitudinal direction which is horizontal. Said connector tubes are then obtained, which tubes are made of metal, for example. Their bottom lengths are thrust into grooves provided for this purpose in the top faces of the beams, leaving the connector axes vertical. Their top lengths are then embedded in the concrete when a slab is cast. The function of the connectors is to prevent relative horizontal displacement between the wooden beams and the concrete slab when the floor is subjected to bending forces. Their effectiveness is ensured by the facts that when embedded in the concrete their top lengths retain a constant position and orientation as imposed by the rigidity of the concrete, and that their tubular shape ensures that they have sufficient stiffness themselves firstly to avoid deforming in their middles situated in the vicinity of the wood-concrete interface, and secondly, to avoid setting up a wedging or setting effect where they engage the wood. They apply stress to the wood which is distributed as uniformly as possible over the entire depth of their housings. Further, the tubular shape of the connectors and their vertical disposition makes it possible to obtain the desired bending strength of the floor using a smaller number of connectors and a smaller quantity of metal than would be possible using other methods.

BRIEF DESCRIPTION OF THE DRAWING

An implementation of the invention falling within the scope of the above-given explanation is now described in greater detail by way of non-limiting example with reference to the accompanying diagrammatic figures. When the same item is shown in two or more figures, it is designated by the same reference symbol.

The implementation described includes the dispositions mentioned above as being preferable in accordance with the present invention. It should be understood that the items mentioned may be replaced by other items performing the same technical functions.

MORE DETAILED DESCRIPTION

Figure 1:
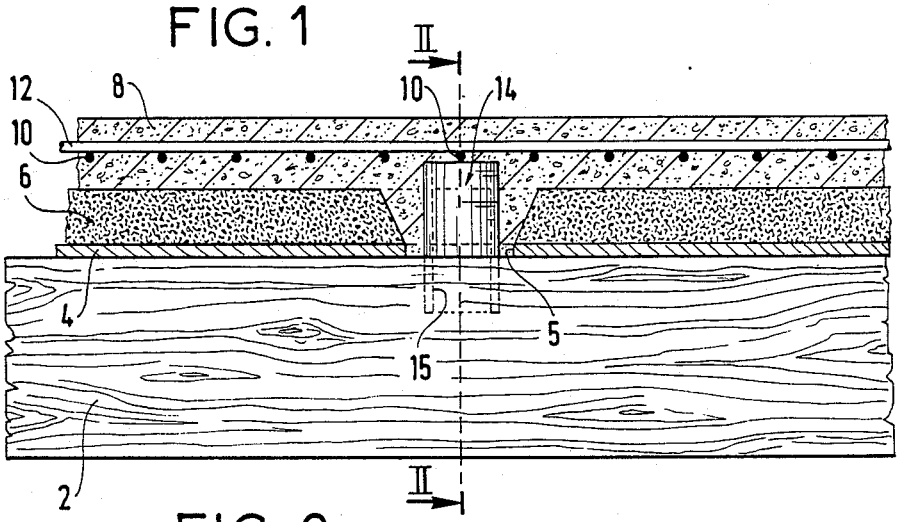
FIG. 1 is a fragmentary section on a longitudinal vertical plane through a floor in accordance with the invention.
Figure 2:
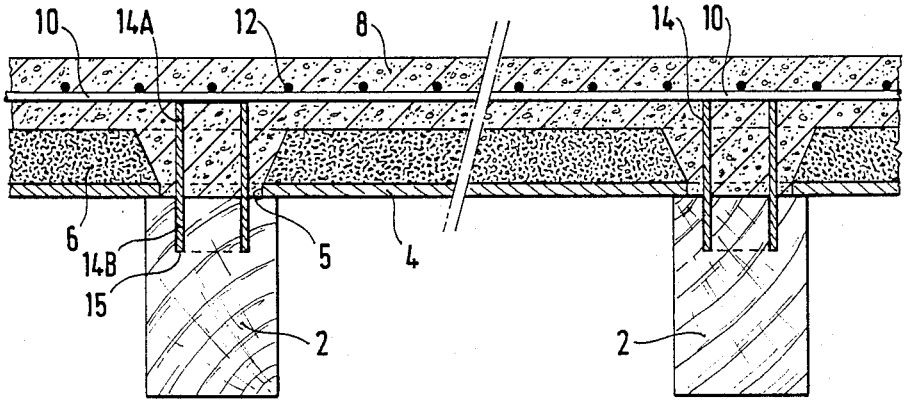
FIG. 2 is a view of the same floor shown in fragmentary section on a vertical transverse plane II—II of FIG. 1.
Figure 3:
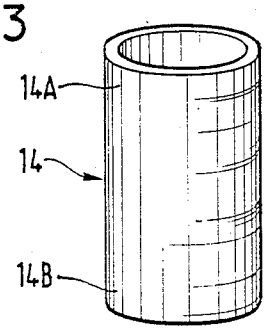
FIG. 3 is a perspective view of a connector tube for said floor, prior to said connector tube being incorporated in the floor.

As shown in FIGS. 1 and 2, the floor described by way of example comprises wooden beams or joists such as 2 which may be made of solid wood or of laminated and glued wood, and which extend longitudinally in the same direction as their fibers. Conventional type non-reusable shuttering 4 rests on the beams. A layer of sound and heat insulation 6 is placed on the shuttering, but it should be understood that this layer may be omitted without losing the advantage specific to the present invention. A concrete slab 8 is cast over this layer. It is reinforced in conventional manner by a metal force-distributing trellis which comprises transverse reinforcing rods such as 10 and longitudinal reinforcing rods such as 12. The beams may be at a spacing of about 0.6 meters (m) to about 1.2 m, e.g. 0.7 m.

Connector tubes 14 extend vertically and each of them has a bottom length 14B received in a beam 2 and a top length 14A received in the slab 8, for example up to within 2 cm of the top face thereof. The trellis 10, 12 is placed over the connector tubes which serve to hold it up while the slab is being cast. Such connector tubes may also have an intermediate length level with the shuttering 4 and the layer of insulation 6 which is not embedded in the wood or in the shuttering.

The shuttering 4 and the layer of insulation 6 have holes 5 drilled therein which are of larger diameter than the connector tubes to allow concrete to fill up the space on either side of the walls of the connector tubes 14 without segregation when the slab is being cast. The diameter of each hole in the shuttering 4 is nevertheless small enough to ensure that the edge of the hole rests against the beam 2 all the way around the hole.

The connector tubes 14 are circular in section having a diameter of 40 mm to 100 mm depending on the span of the beams and they have a height of 8 cm to 12 cm. The metal sheet from which they are made is 2 mm thick, for example.

They are received in the wood by being forced into respective circular grooves 15 which constitute said housings and which are prior formed in the beam by means of a bell-shaped saw. Each groove 15 may be 4 cm deep, for example.

The inside and outside diameters of the tool should be selected, for example, to be exactly the same as the inside and outside diameters of the connector tubes, thereby requiring the application of a moderate vertical force for engaging the tubes.

Under such conditions, it is generally pointless to use a glue to bind the connector to the wood.

The connector tubes are made of building-grade steel. They could be made of other materials of uniform large mechanical strength, for example glass fiber reinforced resin.

They are embedded in the concrete of the slab by casting said concrete, which then flows around the inside and the outside of each tube. Since the embedding of the tubes in the concrete is perfect and since the tubes are very rigid, there is practically no wedging or splitting effect in the wood, i.e. shear forces at the wood-concrete join are transmitted in the form of uniform lateral pressure of metal on wood.

Vertical sliding between the concrete slab and the connector may occur, for example in the presence of high frequency alternating loads. It is prevented simply by leaving a rough sawn edge on the top edge of each tube, for example. It can also be prevented by welding the reinforcing rods to the tubes.

In a variant, it should be understood that the circular section cylindrical connector tubes could be made in the form of tubes which are split along a generator line in order to adapt more easily to housings having slightly different diameters.

I claim:

1. A floor having co-operation between wood and concrete, said floor comprising:

beams of wood extending along a longitudinal direction and following one another in a transverse direction in a substantially horizontal beam plane, said beams resting on supports for supporting the floor, each beam having a top face, a bottom face, and two side faces;

a slab of cast concrete formed on said beams in order to constitute the floor surface and to contribute to the strength of the floor, said concrete including aggregate and being in a solidified form; and connectors each having a bottom length received in one of said beams and a top length received in said slab for transmitting internal longitudinal forces which are applied between the concrete of said slab and the wood of said beams and which result from bending loads applied to the floor;

the improvement wherein each of said connectors is in the form of a connector tube, said connector tube bottom length occupying a housing hollowed out in the wood from said top face of one of said beams and said bottom length constituting an extended bearing surface for said connector tube to bear against a wall of said housing for transmitting said internal longitudinal forces, and whereby such forces are spread over all of said bearing surface due to the stiffness which results from the tubular form of said connector tube.

2. A floor according to claim 1, wherein said tube bottom length has walls permanently pressed against walls of said housing.

3. A floor according to claim 1, wherein said connector tube and said housing have a section which is circular in shape so as to facilitate fabrication of said tube and hollowing said housing.

4. A floor according to claim 3, wherein said housing is a hollowed groove within said beam such that a core of wood of said beam is placed inside said bottom length.

5. A floor according to claim 1, wherein the diameter of said connector tube is sufficiently large to enable the aggregate to penetrate into said top length of such tube easily as said concrete is introduced in a non solidified form to form said cast concrete slab.

6. A floor according to claim 1, wherein said connector tube is made of a material of the group consisting of steel and reinforced resin.

7. A floor according to claim 3, wherein the diameter of said connector tube lies between about 30 mm and about 130 mm.

8. A floor according to claim 1, wherein the height of said connector tube lies between about 6 cm and about 15 cm.

9. A floor according to claim 1, wherein said bottom length of the connector tube penetrates into the top face of said beam over a fraction which is less than one half of the height of said beam.

10. A floor according to claim 1, wherein said connector tube has a diameter which is less than the width of said beam in said transverse direction, and said tube bottom length remains at a distance from said side faces of said beam so as to be protected against heat and/or corrosion by a thickness of wood.

* * * * *